US012557848B2

(12) United States Patent
Schumacher

(10) Patent No.: US 12,557,848 B2
(45) Date of Patent: Feb. 24, 2026

(54) AEROSOL GENERATING DEVICE

(71) Applicant: JT International SA, Geneva (CH)

(72) Inventor: Kevin Schumacher, Jona (CH)

(73) Assignee: JT International SA (CH)

( * ) Notice: Subject to any disclaimer, the term of this patent is extended or adjusted under 35 U.S.C. 154(b) by 551 days.

(21) Appl. No.: 17/927,185

(22) PCT Filed: May 15, 2021

(86) PCT No.: PCT/EP2021/062904
§ 371 (c)(1),
(2) Date: Nov. 22, 2022

(87) PCT Pub. No.: WO2021/233794
PCT Pub. Date: Nov. 25, 2021

(65) Prior Publication Data

US 2023/0200448 A1 Jun. 29, 2023

(30) Foreign Application Priority Data

May 22, 2020 (EP) ..... 20176126

(51) Int. Cl.
*A24F 40/485* (2020.01)
*A24F 40/465* (2020.01)
*A24F 40/85* (2020.01)

(52) U.S. Cl.
CPC ..... *A24F 40/485* (2020.01); *A24F 40/465* (2020.01); *A24F 40/85* (2020.01)

(58) Field of Classification Search
None
See application file for complete search history.

(56) References Cited

U.S. PATENT DOCUMENTS

2013/0068219 A1 3/2013 Collazo et al.
2013/0327327 A1 12/2013 Edwards et al.
(Continued)

FOREIGN PATENT DOCUMENTS

GB 2534212 A 7/2016
GB 2534215 A 7/2016
(Continued)

OTHER PUBLICATIONS

International Search Report for Application No. PCT/EP2021/062904 mailed Sep. 3, 2021, pp. 1-3.

*Primary Examiner* — Linda L Gray
(74) *Attorney, Agent, or Firm* — Lerner David LLP

(57) ABSTRACT

An aerosol generating device comprising first and second housing elements configured to move between an open position and a closed position, wherein, in the closed position, the first and second housing elements together define an aerosol generation chamber configured to enclose a portion of aerosol generating substrate, and further define an air flow channel comprising an inlet, an outlet and the aerosol generation chamber, wherein the first and/or second housing element comprises a sealing member configured to seal at least part of the air flow channel between the inlet and outlet, in the closed position, the first and second housing elements are configured to engage with each other to define the aerosol generation chamber by moving along an approach direction, and the sealing member comprises a wall member extending in the approach direction.

16 Claims, 7 Drawing Sheets

(56) References Cited

U.S. PATENT DOCUMENTS

| | | | | |
|---|---|---|---|---|
| 2014/0116426 | A1 | 5/2014 | Mullinger et al. | |
| 2017/0035113 | A1* | 2/2017 | Thorens | A24F 40/485 |
| 2017/0095623 | A1 | 4/2017 | Trzecieski | |
| 2019/0098930 | A1* | 4/2019 | Fallon | A61M 15/06 |
| 2020/0221767 | A1 | 7/2020 | Emmett et al. | |

FOREIGN PATENT DOCUMENTS

| | | | |
|---|---|---|---|
| JP | H11346751 | A | 12/1999 |
| JP | 5439629 | B1 | 3/2014 |
| JP | 2019513349 | A | 5/2019 |
| JP | 2019519224 | A | 7/2019 |
| WO | 2017202965 | A1 | 11/2017 |
| WO | 2019016737 | A1 | 1/2019 |
| WO | 2019243540 | A1 | 12/2019 |

* cited by examiner

AEROSOL GENERATING DEVICE

CROSS-REFERENCE TO RELATED APPLICATIONS

The present application is a national phase entry under 35 U.S.C. § 371 of International Application No. PCT/EP2021/062904, filed May 15, 2021, published in English, which claims priority to European Application No. 20176126.9, filed May 22, 2020, the disclosures of which are incorporated herein by reference.

TECHNICAL FIELD

The present disclosure relates to an aerosol generation device in which an aerosol generating substrate is heated to form an aerosol. The disclosure is particularly applicable to a portable aerosol generation device, which may be self-contained and low temperature. Such devices may heat, rather than burn, tobacco or other suitable aerosol substrate materials by conduction, convection, and/or radiation, to generate an aerosol for inhalation.

BACKGROUND

The popularity and use of reduced-risk or modified-risk devices (also known as vaporisers) has grown rapidly in the past few years as an aid to assist habitual smokers wishing to quit smoking traditional tobacco products such as cigarettes, cigars, cigarillos, and rolling tobacco. Various devices and systems are available that heat or warm aerosolisable substances as opposed to burning tobacco in conventional tobacco products.

A commonly available reduced-risk or modified-risk device is the heated substrate aerosol generation device or heat-not-burn device. Devices of this type generate an aerosol or vapour by heating an aerosol substrate that typically comprises moist leaf tobacco or other suitable aerosolisable material to a temperature typically in the range 150° C. to 350° C. Heating an aerosol substrate, but not combusting or burning it, releases an aerosol that comprises the components sought by the user but not the toxic and carcinogenic by-products of combustion and burning. Furthermore, the aerosol produced by heating the tobacco or other aerosolisable material does not typically comprise the burnt or bitter taste resulting from combustion and burning that can be unpleasant for the user and so the substrate does not therefore require the sugars and other additives that are typically added to such materials to make the smoke and/or vapour more palatable for the user.

The released aerosol is typically drawn out of the device by a user inhaling through a mouthpiece. The inhaling creates air flow through the device which carries the aerosol to the user. However, if an air flow path from the heated substrate to the mouthpiece is inadequately sealed, air may flow to the user from elsewhere, meaning that the user must inhale harder or for longer to obtain a same amount of aerosol.

Accordingly, it is desirable to provide an aerosol generating device with improved sealing of an air flow route through the device.

SUMMARY

According to a first aspect, the present invention provides an aerosol generating device comprising first and second housing elements configured to move between an open position and a closed position, wherein, in the closed position, the first and second housing elements together define an aerosol generation chamber configured to enclose a portion of aerosol generating substrate, and further define an air flow channel comprising an inlet, an outlet and the aerosol generation chamber, wherein the first and/or second housing element comprises a sealing member configured to seal at least part of the air flow channel between the inlet and outlet, in the closed position.

By providing a sealing member, air leaking between the first and second housing elements is reduced, and the air flow through the aerosol generating device can be more precisely designed to improve heating efficiency and quality of the generated aerosol.

Optionally, the first and second housing elements are configured to engage with each other to define the aerosol generation chamber by moving along an approach direction, wherein the sealing member comprises a wall member extending in the approach direction.

By providing a wall member extending in the approach direction, a seal is established when the first and second housing elements meet at the closed position.

Optionally, one of the first and second housing elements comprises the wall member, the other of the first and second housing elements comprises a sliding contact wall extending in the approach direction, and the wall member is configured to slide against the sliding contact wall when the first and second housing elements move near the closed position.

By configuring the wall member to slide against the sliding contact wall, the seal is still effective even if the first and second housing elements are not exactly in the closed position. In other words, the user does not have to precisely position the housing elements to establish a seal.

Optionally, the wall member comprises a first wall portion extending along the air flow channel.

A wall member extending in the approach direction and along the air flow channel has the effect of preventing sideways leaking of air to or from the air flow channel between the housing elements. This reduces cooling from air leaking into the air flow channel, and reduces aerosol loss from air leaking out of the air flow channel.

Optionally, the wall member comprises a second wall portion extending along a closed end of the air flow channel.

By sealing an end of the air flow channel, it can be ensured that air flows from the inlet to the outlet.

Optionally, the wall member extends continuously from a first end at an open end of the air flow channel, around the aerosol generation chamber, to a second end at the open end of the air flow channel.

In other words, the wall member forms an open loop around the air flow channel. This provides a simple, robust construction for sealing an end of the air flow channel and sealing sides of the air flow channel.

Optionally, the first or second housing element comprises a through hole connected to the inlet or outlet of the air flow channel.

This arrangement with a through hole allows the inlet or outlet to be more precisely defined than a shape which relies on the first and second housing elements being in a specific closed position.

Optionally, the inlet or outlet is a gap between the first and second housing elements in the closed position, the gap corresponding to an open end of the air flow channel.

By providing the inlet or outlet as a gap between the housing elements, the inlet or outlet can be easily cleaned. This is particularly advantageous for the outlet, which may be expected to come into contact with a mouth of a user of the aerosol generation device.

Optionally, the first and second housing elements are attached by a hinge.

Attaching the housing elements by a hinge means that the open and closed positions can be defined as ends of a one-dimensional range of motion, making the device easy for a user to operate.

Optionally, the hinge is arranged at an end of the air flow channel opposing the gap.

This configuration with a gap opposite the hinge addresses the issue that the end of the housing elements that is furthest from the hinge has the largest range of motion, and thus is the most difficult to seal effectively.

Optionally, the device has an alligator configuration in which a mouthpiece end is configured to open around the hinge, and the first or second housing element extends beyond the hinge to provide a handle end.

This configuration is particularly straightforward to operate, because the aerosol generating device can be held by hand in a same position on the handle end both for inhaling aerosol through the mouthpiece and for moving the housing elements to the open position to replace the portion of aerosol generating substrate.

Optionally, the sealing member comprises an elastomer material.

Optionally, the first housing element comprises an open-top chamber configured to receive the portion of aerosol generating substrate, and the second housing element comprises a moveable cover for closing the chamber.

Optionally, the first housing element comprises a platform portion protruding from a main surface, wherein the open-top chamber is formed in the platform portion, the moveable cover is configured to engage with the platform portion and the main surface, and the sealing member is arranged on a side wall of the platform portion or is arranged on a surface of the moveable cover configured to engage with the side wall of the platform portion.

The platform portion and the moveable cover which engages with it provide a mating surfaces that extend along the approach direction, inhibiting air flow outside of the air flow channel. At the same time, the platform increases a depth of the first housing element available to fit the open-top chamber, meaning that the overall device can be thinner for a given size of the open-top chamber.

Optionally, the first housing element comprises a heating element arranged at a bottom surface of the open-top chamber.

Optionally, the second housing element comprises an inner surface arranged to face the open-top chamber in the closed position, wherein the inner surface comprises a thermally conductive material.

The thermally conductive material has the effect of increasing the evenness of heating the portion of aerosol generating substrate.

DETAILED DESCRIPTION

Figure 1B:
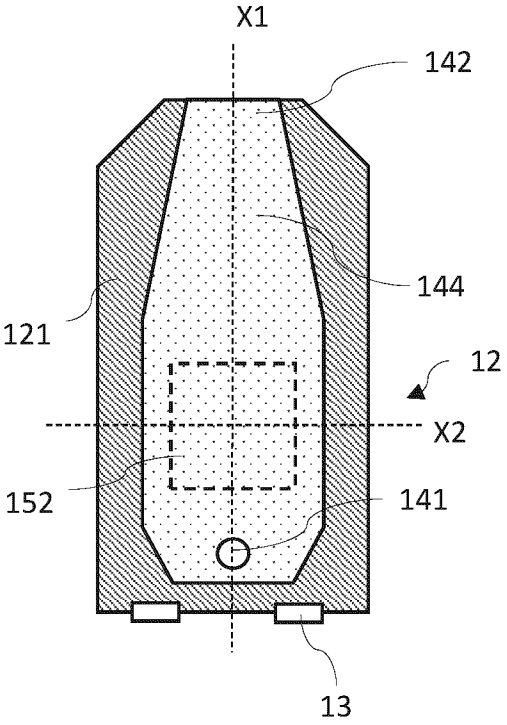
FIGS. 1A and 1B are schematic illustrations of separate housing elements an aerosol generating device 1 according to a first example of the invention.
Figure 1A:
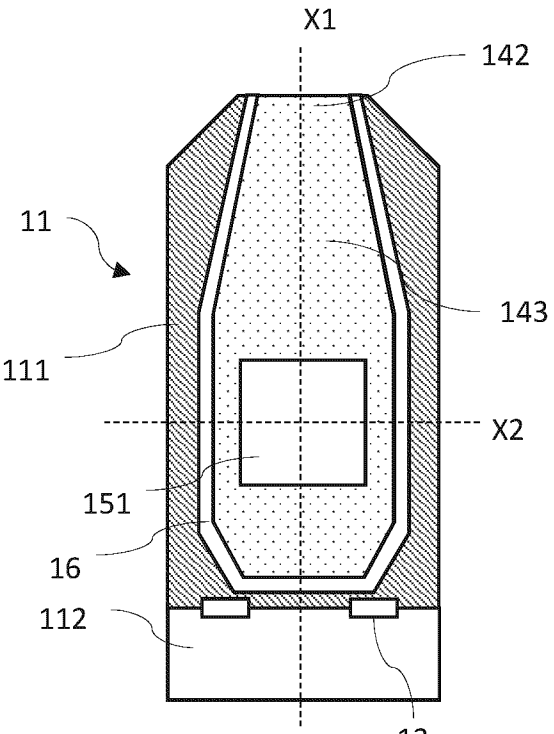

FIG. 1A is a schematic illustration of a first housing element 11 of an aerosol generating device 1, and FIG. 1B is a schematic illustration of a second housing element 12 of the aerosol generating device 1. The main bodies of the first and second housing elements 11, 12 may, for example, be made from a medical grade high temperature plastic material. Preferably, the plastic material is a 3D printable material.

The first and second housing elements 11 and 12 are attached to each other by an attachment means 13, and are configured to move relative to each other between an open position and a closed position.

The attachment means 13 may, for example, be a hinge or a flexible portion of housing that confines the relative motion of the first and second housing elements 11 and 12 to a predetermined path of motion. Alternatively, the first and second elements 11 and 12 may be more generally attached, for example with a cable. Additionally or alternatively the first and second housing elements 11 and 12 may be entirely separable. For example, the attachment means 13 may be a detachable element such as a clip, or may be omitted entirely.

When the aerosol generating device 1 is in the closed position, the first and second housing elements 11 and 12 together define an air flow channel 14 comprising an inlet 141 and an outlet 142.

In the example illustrated in FIGS. 1A and 1B, the air flow channel 14 is defined between a surface 143 of the first housing element 11 and a surface 144 of the second housing element 12.

Additionally, when the aerosol generating device 1 is in the closed position, the first and second housing elements 11 and 12 together define an aerosol generation chamber 15 configured to enclose a portion of aerosol generating substrate.

Referring to FIGS. 1A and 1B, in the illustrated example the aerosol generation chamber is formed from an open-top chamber 151 in the first housing element 11 configured to receive the portion of aerosol generating substrate, and from a surface 152 of the second housing element 12 functioning as a moveable cover for the aerosol generation chamber 15. The open-top chamber 151 may simply be a recess in the surface 141 of the first housing element 11.

When the aerosol generating device 1 is in the open position, the first housing element 11 is spaced apart from the second housing element 12, and the user can access the open top chamber 151. In this position, the user can add or remove the portion of aerosol generating substrate. In particular, as aerosol is generated, the substrate is consumed and so it must be periodically replaced by moving the first and second housing elements 11, 12 to the open position. On the other hand, when the aerosol generating device 1 is in the closed position, the surface 152 covers the aerosol generation chamber 15, and the portion of aerosol generating substrate can be efficiently heated to generate aerosol.

The aerosol generating substrate (not shown) may for example comprise nicotine or tobacco and an aerosol former. Tobacco may take the form of various materials such as shredded tobacco, granulated tobacco, tobacco leaf and/or reconstituted tobacco. Suitable aerosol formers include: a polyol such as sorbitol, glycerol, and glycols like propylene glycol or triethylene glycol; a non-polyol such as monohydric alcohols, acids such as lactic acid, glycerol derivatives, esters such as triacetin, triethylene glycol diacetate, triethyl citrate, glycerin or vegetable glycerin. In some examples, the aerosol generating agent may be glycerol, propylene glycol, or a mixture of glycerol and propylene glycol. The substrate may also comprise at least one of a gelling agent, a binding agent, a stabilizing agent, and a humectant.

The portion of aerosol generating substrate is preferably shaped to fit in the open-top chamber 151. For example, the portion may be substantially cuboid having a length L and width W corresponding to the open-top chamber 151.

When the aerosol generating device 1 is in the closed position, the air flow channel 14 intersects with the aerosol generation chamber 15, such that aerosol generated in the aerosol generation chamber 15 can be drawn along the air flow channel 14 towards the outlet 144.

Each of the first and second housing elements 11 and 12 in this example comprises a wall portion 111, 112 adjacent to the air flow channel 14. In the closed position, the wall portions 111, 112 define a wall of the air flow channel 14 between the inlet 141 and the outlet 142.

However, the open position and closed position each have a certain tolerance. The user of the aerosol generating device 1 may not firmly close the device 1 meaning that there is at least some gap between the first and second housing elements 11, 12, even in the closed position. As a result, there is a need to improve sealing in the closed position.

In order to improve the seal of the air flow channel 14 in the closed position, a sealing member 16 is provided on the first housing element 11. The sealing member 16 is configured to seal at least part of the air flow channel between the inlet 141 and outlet 142, in the closed position. By improving the sealing of the air flow channel 14, air flow from the inlet 141 to the outlet 142 is increased, and leakage of air through other gaps between the first and second housing elements 11 and 12 is reduced. Since the sealing member 16 is configured to seal between the first and second housing elements 11 and 12, the sealing member 16 may be attached to either of the first housing element 11 and second housing element 12, and/or may contain a first section attached to the first housing element 11 and a second section attached to the second housing element 12.

Figure 2A:
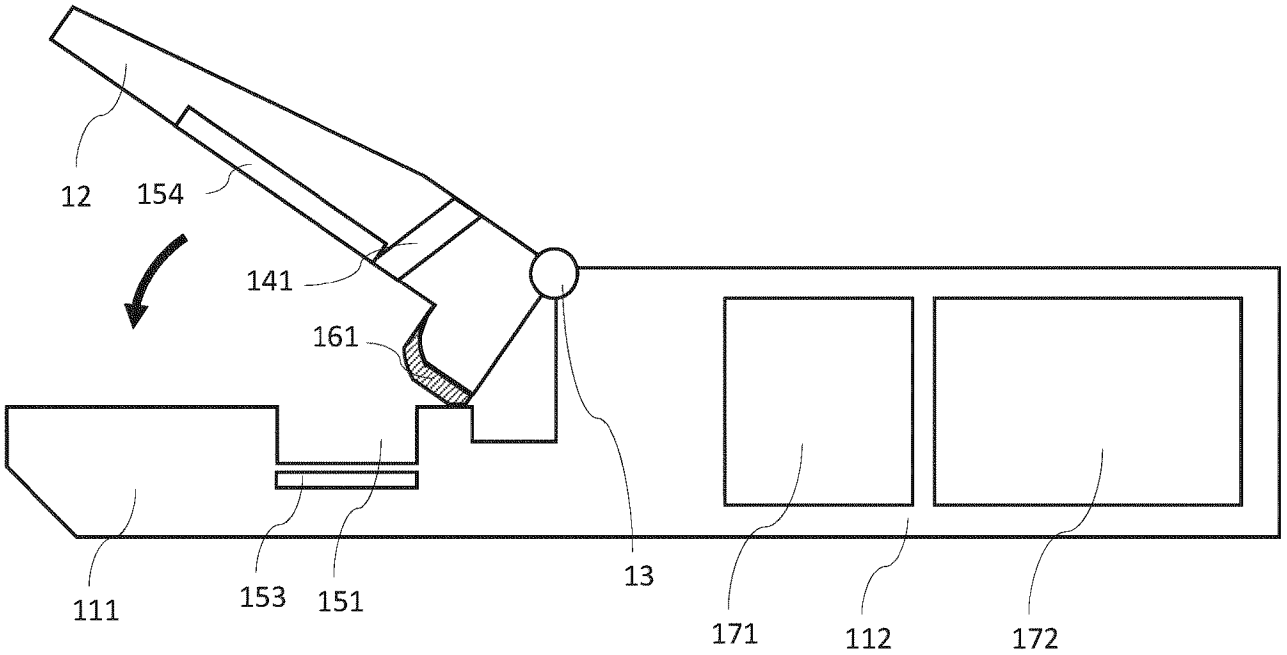
FIGS. 2A and 2B are schematic cross-section illustrations of the aerosol generating device 1, in a first plane.
Figure 2B:
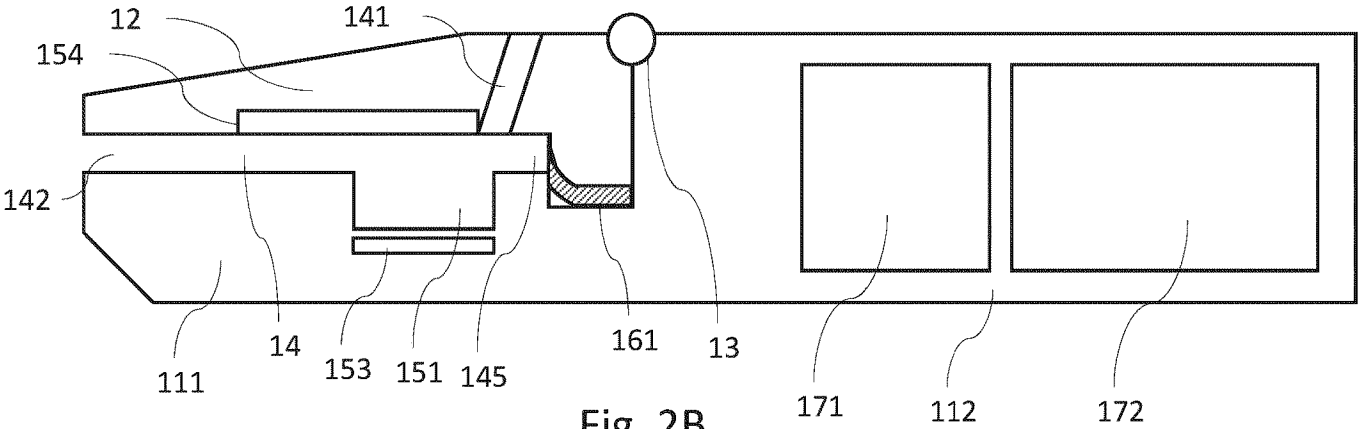

In order to further explain the sealing member 16, it is useful to refer to a cross-section along line X1 of FIGS. 1A and 1B, as shown in FIGS. 2A and 2B. In FIG. 2A, the aerosol generation device 1 is in the open position and, in FIG. 2B, the aerosol generation device 1 is in the closed position.

More specifically, in the first example, the first and second housing elements 11, 12 are configured to engage with each other to define the aerosol generation chamber 15 by moving along an approach direction illustrated with an arrow in FIG. 2A.

The sealing member 16 comprises a first wall member 161 attached to the second housing element 12 and extending in the approach direction such that, as the first and second housing elements 11, 12 approach the closed position, the sealing member 16 can be compressed and deformed to form a tight seal against the first housing element 11.

In order to provide this compression and deformation behaviour, the sealing member 16 is preferably made from an elastic material such as an elastomer. The elastic material may, for example, be a food-proof silicone.

As shown in FIGS. 2A and 2B, the first wall member 161 extends along a closed end 145 of the air flow channel 14. At the same time, the inlet 141 comprises a through hole through the second housing element 12. The through hole could equally be formed through the first housing element 11. By using a through hole instead of a gap between the first and second housing elements 11, 12 to define the inlet 141, the shape of the inlet 141 can be more precisely defined.

In some examples, the outlet 142 may also or alternatively comprise a through hole. However, in this example, the outlet 142 is a gap between the first and second housing elements in the closed position, the gap corresponding to an open end of the air flow channel.

More specifically, the outlet 142 comprises a gap at an end of the air flow channel 14 opposing the attachment means 13 (in this case, a hinge). The combination of a gap outlet 142 between the housing elements at one end of the air flow channel, and a hinge 13 at or beyond the other end of the air flow channel, has the effect that it is not necessary to attempt to seal the first and second housing elements 11, 12 at the point which has the widest range of motion because it is furthest from the hinge, and therefore the point that would otherwise be the most difficult to seal along the air flow channel 14.

FIGS. 2A and 2B also illustrate several other optional features of aerosol generating devices 1.

The aerosol generation chamber 15 of this example comprises a heating element 153 for heating the portion of aerosol generating substrate to generate the aerosol. In other examples, the aerosol generation chamber 15 may instead generate the aerosol via other means, such as by vibration.

The heating element may, for example, be an electrically-resistive track. Alternatively, the heating element may generate heat by a chemical reaction such as combustion.

The heating element may a planar heating element arranged on or within a surface of the recess 151 or the surface 152. Alternatively, the heating element may be connected to either of these surfaces 151, 152 via one or more thermally conductive portions such as portions of metal.

Additionally, in this example, the first housing element 11 comprises a handle end 112 extending beyond the attachment means 13. The handle end 112 provides a part of the aerosol generating device 1 which can be held by hand, while moving the first and second housing elements 11, 12 between the open position and the closed position.

The handle end 112 can also be used for enclosing parts of the aerosol generating device 1 which are not directly involved in air flow or aerosol generation. For example, the handle end 112 may contain control circuitry 171 and/or a power supply 172 (such as a battery). The handle end 112 could, in other examples, instead be an extension of the second housing element 12.

The combination of the handle end 112 at one end of the aerosol generating device 1, the attachment means 13 in a middle point, and a mouthpiece end comprising the outlet 142 which opens to provide access to the aerosol generation chamber 15 when in the open position, can be described as an "alligator" configuration. The "alligator" mechanism has several advantages including making it easier to operate and clean the air flow channel 14 and the aerosol generation chamber 15, and decreasing a required thickness of the aerosol generating device 1 by providing space for components beyond an openable hinged section.

Furthermore, in this example, the second housing element 12 comprises an inner surface 154 arranged to face the open-top chamber 151 in the closed position, wherein the inner surface comprises a thermally conductive material. For example, the inner surface 154 may comprise a metal such as stainless steel or aluminium. By providing such a thermally conductive surface, the temperature in the air flow channel 14 is more uniform, and the quality of the condensed aerosol is improved. Additionally, a metal surface 154 makes the aerosol generating device 1 more robust and easier to clean.

Figure 3B:
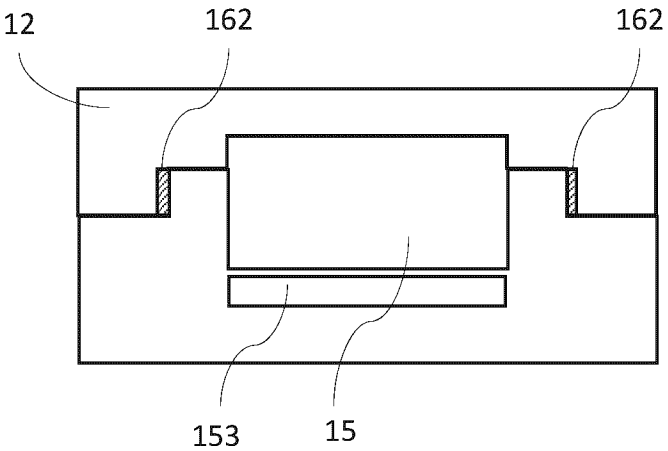
FIGS. 3A and 3B are schematic cross-section illustrations of the aerosol generating device 1, in a second plane.
Figure 3A:
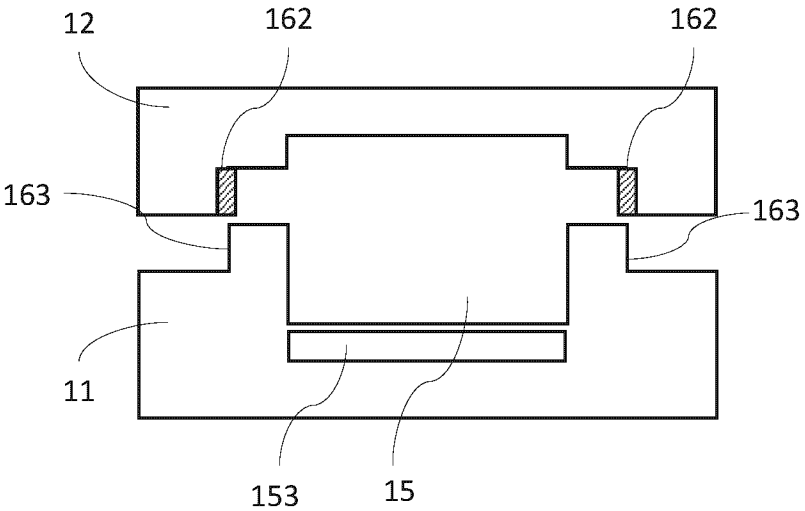

FIGS. 3A and 3B illustrate a cross-section along line X2 in FIGS. 1A and 1B. FIG. 3A shows cross-sections of the first and second housing elements 11, 12 when they are separated in the open position, and FIG. 3B shows cross-sections of the first and second housing elements when they are adjacent in the closed position.

In particular, FIGS. 3A and 3B illustrate a sealing member 16 in the form of a second wall member 162 extending along the air flow channel 14. The second wall member 162 may be provided in addition or alternative to the first wall member 161 described above.

Furthermore, as shown in FIG. 1A, the first and second wall members 161, 162 may be combined to provide a wall member extending continuously from a first end at an open end of the air flow channel, around the aerosol generation chamber, to a second end at the open end of the air flow channel. In the present example, the open end is the outlet 142, although the open end could instead be the inlet 141. By providing a continuous sealing member along sides and an end of the air flow channel 14, the sealing of the air flow channel is further improved.

Preferably, each wall member 161, 162 is configured to meet a sliding contact wall 163 near the closed position. More specifically, a sliding contact wall here means a wall extending in the approach direction on one of the first and second housing elements 11, 12 and configured so that a wall member 161, 162 on the other of the first and second housing elements 11, 12 slides against the sliding contact wall 163 as the first and second housing elements 11, 12 move near the closed position. By providing a sliding contact between the wall member 161, 162 and an opposing wall, the sealing member 16 can provide a sealing effect over a range of relative positions of the first and second housing elements 11, 12 so that the air flow channel 14 is sealed even if the first and second housing elements 11, 12 are not precisely in the closed position.

Figure 4A:
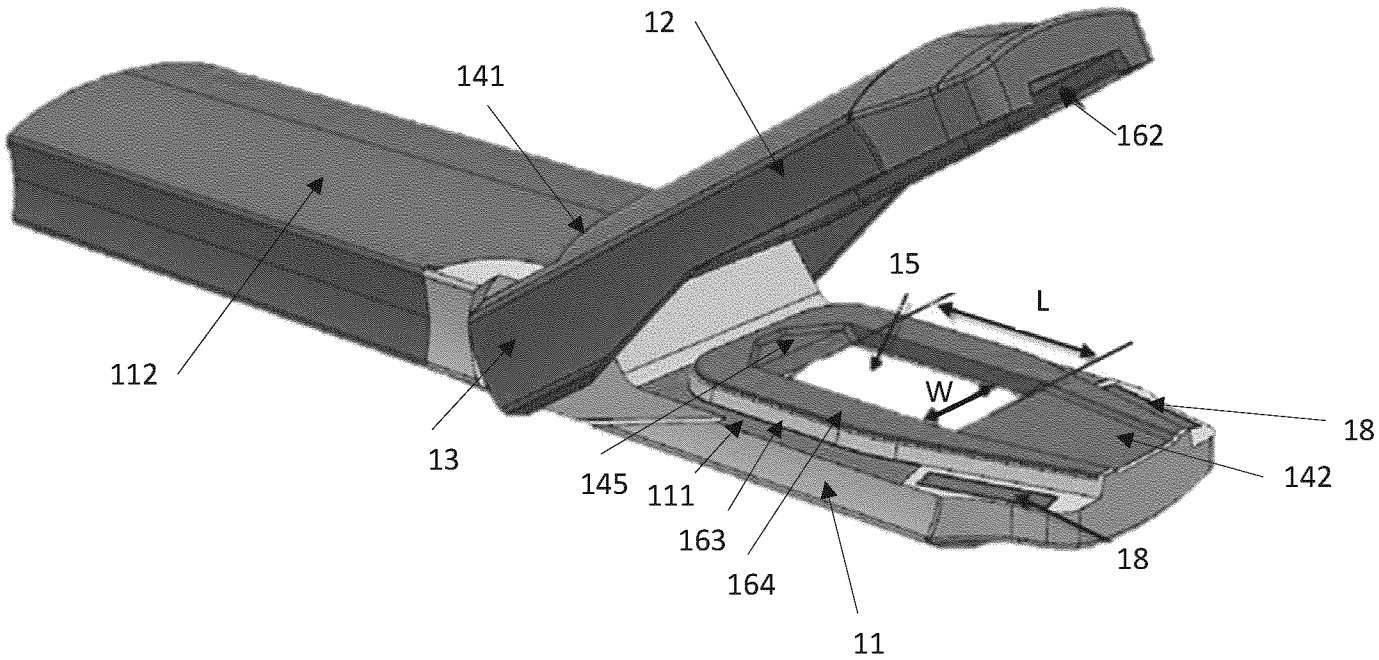
FIGS. 4A and 4B are schematic illustrations of an aerosol generating device 1 according to a second example of the invention.
Figure 4B:
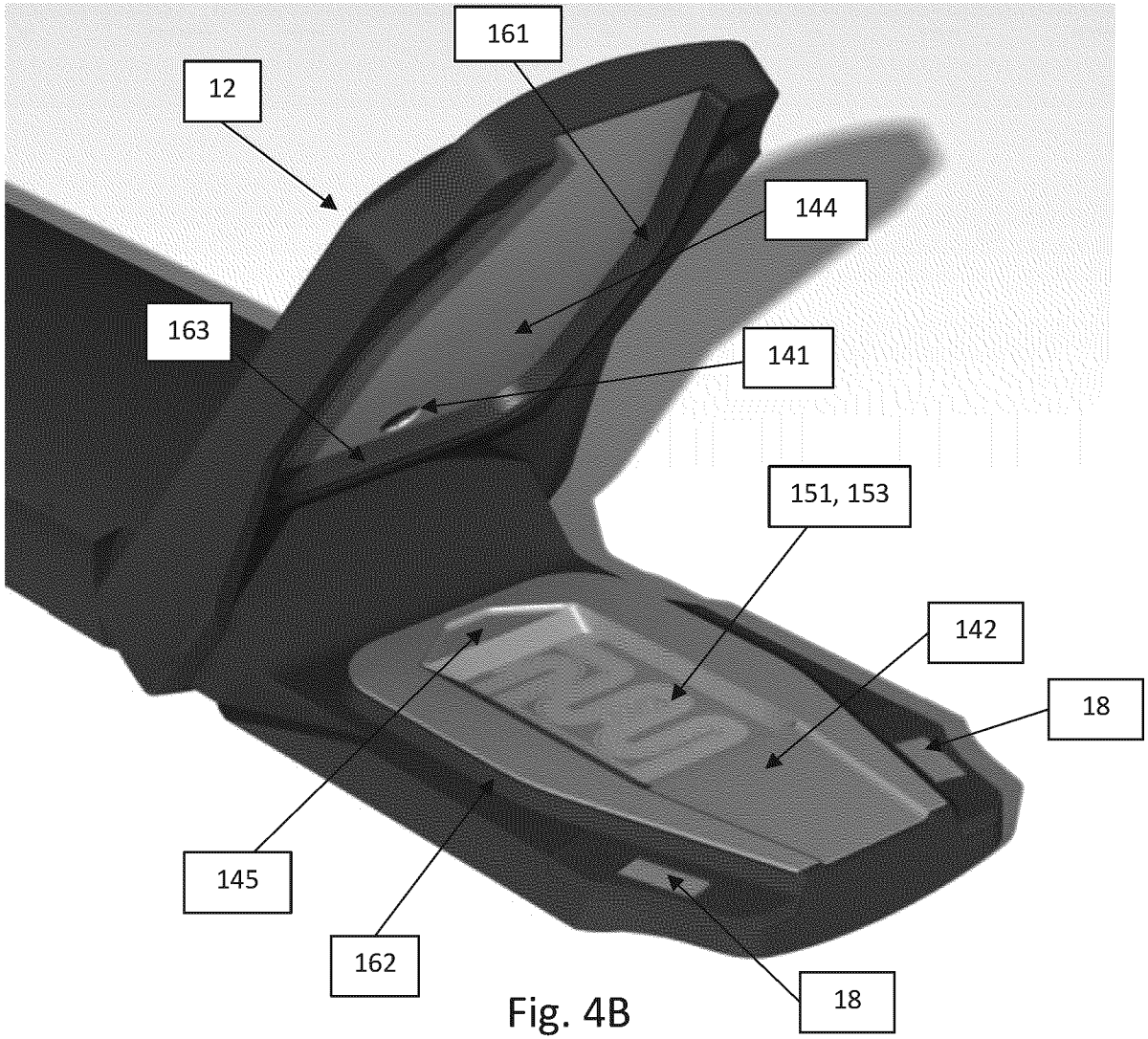

FIGS. 4A and 4B are schematic illustrations of an aerosol generating device 1 according to a second example, with the first and second housing elements 11, 12 in different relative positions. The second example is largely similar to the first example, but has additional optional features.

In the second example, the air flow channel 14 and the open-top chamber 151 take the form of recesses in a platform portion protruding from a surface of the first housing element 11. The moveable cover 152 is configured to engage with a top surface 164 of the platform portion and with a main surface of the wall portion 111.

The platform portion has a sliding contact wall 163 extending along continuously along two sides of the air flow channel 14 and along a closed end 145 of the air flow channel 14, thus providing a surface to engage with a wall member 162 of the sealing member 16 extending continuously along the two sides and the closed end 145 of the air flow channel. Equally, the sliding contact wall 163 and the continuous wall member 162 could be reversed, so that the continuous wall member is arranged on the side wall of the platform portion, and the sliding contact wall is the corresponding surface on the second housing element 12.

The platform portion may be made from a different material from a main body of the first and second housing elements 11, 12. For example, the platform portion may be made from polyether ether ketone (PEEK) which has good mechanical properties at high temperatures for heating an aerosol generating substrate, and has low thermal conductivity. Additionally, PEEK can be food safe, so that nothing is added to the generated aerosol.

Additionally, in the second example, the attachment means 13 is another hinge. However, in this example the hinge 13 is set in a plane of the air flow channel 14, so that the sealing element 16 can more easily form a seal by moving in the approach direction.

Furthermore, as shown in FIGS. 4A and 4B, examples may include a locking element 18 for releasably locking the first and second housing elements 11, 12 in the closed position. For example, the locking element 18 may take the form of a pair of magnets or a clip.

FIG. 4B additionally illustrates an example where a heating element 153 is formed on a bottom surface of the open-top chamber 151. In this case, the heating element 153 comprises a resistive track.

Figure 5B:
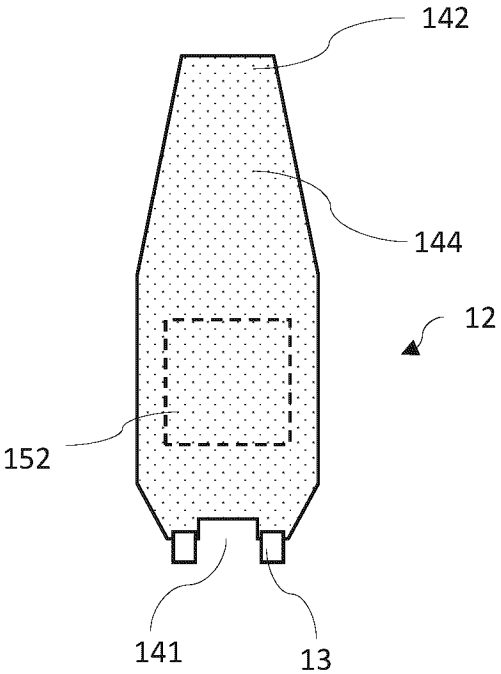
FIGS. 5A and 5B are schematic illustrations of an aerosol generating device 1 according to a third example of the invention.
Figure 5A:
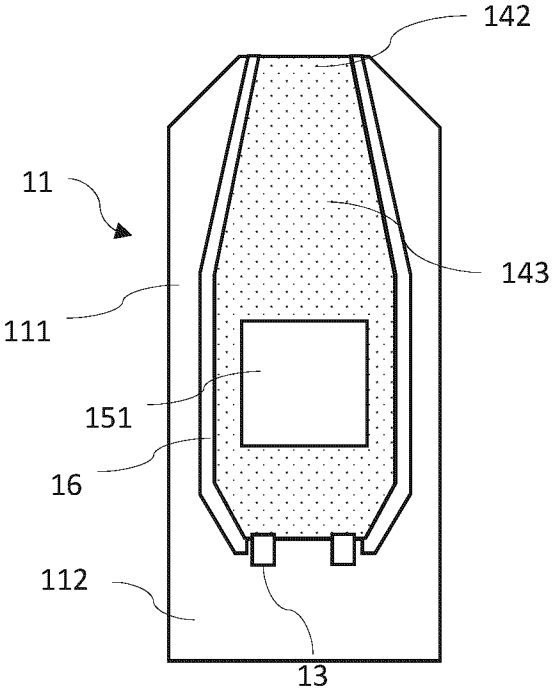

FIG. 5A is a schematic illustration of a first housing element 11 of an aerosol generating device 1 according to a third example, and FIG. 5B is a schematic illustration of a second housing element 12 of the aerosol generating device 1 according to the third example.

The third example illustrates a possible variation of the aerosol generating device 1. Specifically, in this example, the wall portion 112 is omitted from the second housing element 12, and the wall portion 111 of the first housing element 11 extends up to an upper external surface of the aerosol generating device 1. As a result, when the first and second housing elements 11, 12 are in the closed position, any gap between the first and second housing elements 11, 12 cannot extend to an external side of the aerosol generating device 1.

Additionally, in the third example, the inlet 141 is not a through hole in either of the first and second housing elements 11, 12. Instead, a notch is provided in the second housing elements 12 such that, when the aerosol generating device is in the closed position, a gap is formed between the first and second housing elements 11, 12, adjacent to the attachment means 13.

Figure 6:
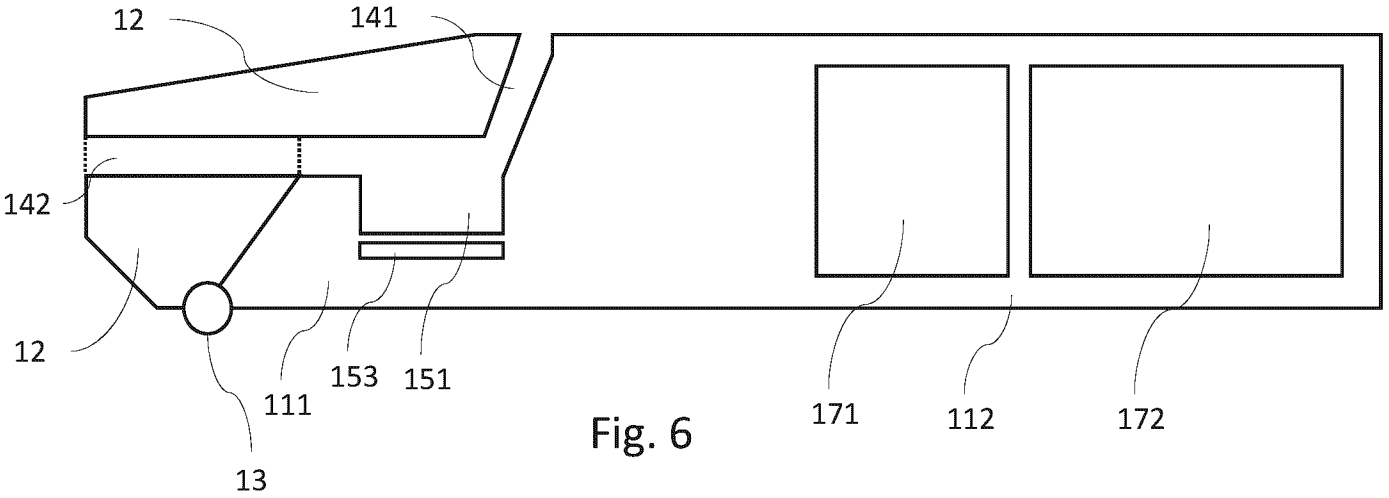
FIG. 6 is a schematic illustrations of an aerosol generating device 1 according to a fourth example.

FIG. 6 is a schematic illustration of an aerosol generating device 1 according to a fourth example, illustrating a further possible modification of the above described examples.

Specifically, in this example, the "alligator" configuration is replaced with a configuration in which the attachment means 13 is arranged close to an end of the device. The end of the device has the outlet 142 of the air flow channel 14. In this example, the outlet 142 is a through hole through the second housing element 12. This is illustrated with a dashed line connecting the second housing element 12 above and below the air flow channel 14 as shown in FIG. 6. Additionally, the inlet 141 is a gap between the first and second housing elements 11, 12. Instead of opening a mouthpiece end of the aerosol generating device 1 to replace the portion of aerosol generating substrate, in this example the device 1 opens part-way along its length, near to the inlet 141. This configuration may reduce a length of a join between the first and second housing elements 11, 12 in the closed position, and thereby reduce a length of a sealing member 16 required to seal the join. The sealing member 16 may nevertheless be similar to the above-described examples.

The invention claimed is:

1. An aerosol generating device comprising first and second housing elements configured to move between an open position and a closed position, wherein:

in the closed position, the first and second housing elements together define an aerosol generation chamber configured to enclose a portion of an aerosol generating substrate, and further define an air flow channel comprising an inlet, an outlet and the aerosol generation chamber, the first and/or second housing element comprises a sealing member configured to seal at least part of the air flow channel between the inlet and outlet, in the closed position, the first and second housing elements are configured to engage with each other to define the aerosol generation chamber by moving along an approach direction, and the sealing member comprises a wall member extending in the approach direction.

2. The aerosol generating device according to claim 1, wherein:

one of the first and second housing elements comprises the wall member, the other of the first and second housing elements comprises a sliding contact wall extending in the approach direction, and the wall member is configured to slide against the sliding contact wall when the first and second housing elements move toward the closed position.

3. The aerosol generating device according to claim 1, wherein the wall member comprises a first wall member extending along a closed end of the air flow channel.

4. The aerosol generating device according to claim 3, wherein the wall member comprises a second wall member extending along the air flow channel.

5. The aerosol generating device according to claim 1, wherein the wall member extends continuously from a first end at an open end of the air flow channel, around the aerosol generation chamber, to a second end at the open end of the air flow channel.

6. The aerosol generating device according to claim 1, wherein the first or second housing element comprises a through hole connected to the inlet or outlet of the air flow channel.

7. The aerosol generating device according to claim 1, wherein the inlet or outlet is a gap between the first and second housing elements in the closed position, the gap corresponding to an open end of the air flow channel.

8. The aerosol generating device according to claim 1, wherein the first and second housing elements are attached by a hinge.

9. The aerosol generating device according to claim 8, wherein the hinge is arranged at an end of the air flow channel opposing the gap.

10. The aerosol generating device according to claim 9, wherein the device has an alligator configuration in which a mouthpiece end is configured to open around the hinge, and the first or second housing element extends beyond the hinge to provide a handle end.

11. The aerosol generating device according to claim 1, wherein the first housing element comprises an open-top chamber configured to receive the portion of the aerosol generating substrate, and the second housing element comprises a moveable cover for closing the chamber.

12. The aerosol generating device according to claim 11, wherein the first housing element comprises a platform portion protruding from a main surface, wherein the open-top chamber is formed in the platform portion, the moveable cover is configured to engage with the platform portion and the main surface, and the sealing member is arranged on a side wall of the platform portion or is arranged on a surface of the moveable cover configured to engage with the side wall of the platform portion.

13. The aerosol generating device according to claim 11, wherein the first housing element comprises a heating element arranged at a bottom surface of the open-top chamber.

14. The aerosol generating device according to claim 11, wherein the second housing element comprises an inner surface arranged to face the open-top chamber in the closed position, wherein the inner surface comprises a thermally conductive material.

15. The aerosol generating device according to claim 11, wherein the first housing element comprises an electrically-resistive track arranged at a bottom surface of the open-top chamber.

16. The aerosol generating device according to claim 11, wherein the first housing element comprises a heater arranged at a bottom surface of the open-top chamber.

* * * * *